US009777514B2

(12) United States Patent
Haidvogl

(10) Patent No.: US 9,777,514 B2
(45) Date of Patent: Oct. 3, 2017

(54) LOCK HAVING A SECURITY DEVICE FOR AN AUTOMATIC STORAGE MACHINE AND AUTOMATIC STORAGE MACHINE

(71) Applicant: KEBA AG, Linz (AT)

(72) Inventor: Franz Engelbert Haidvogl, Ehrendorf (AT)

(73) Assignee: KEBA AG, Linz (AT)

( * ) Notice: Subject to any disclaimer, the term of this patent is extended or adjusted under 35 U.S.C. 154(b) by 186 days.

(21) Appl. No.: 14/888,121

(22) PCT Filed: Apr. 23, 2014

(86) PCT No.: PCT/AT2014/050101

§ 371 (c)(1),
(2) Date: Dec. 2, 2015

(87) PCT Pub. No.: WO2014/176619

PCT Pub. Date: Nov. 6, 2014

(65) Prior Publication Data

US 2016/0160535 A1 Jun. 9, 2016

(30) Foreign Application Priority Data

May 2, 2013 (DE) ..... 10 2013 104 495

(51) Int. Cl.
*E05C 19/10* (2006.01)
*E05B 65/462* (2017.01)
(Continued)

(52) U.S. Cl.
CPC ..... *E05B 65/462* (2013.01); *A47B 81/00* (2013.01); *A47B 88/40* (2017.01); *A47F 10/00* (2013.01);
(Continued)

(58) Field of Classification Search
CPC ..... E05B 47/0012; E05B 47/0004; E05B 17/0029; E05B 47/0607; E05B 15/0295;
(Continued)

(56) References Cited

U.S. PATENT DOCUMENTS 3,312,491 A 4/1967 Peters
6,378,920 B1 4/2002 Ostrowski et al.
(Continued)

FOREIGN PATENT DOCUMENTS

DE 23 03 226 A1 8/1974
EP 2 176 477 B1 7/2011

OTHER PUBLICATIONS

International Search Report of PCT/AT2014/050101, dated Oct. 1, 2014.

*Primary Examiner* — Mark Williams
(74) *Attorney, Agent, or Firm* — Collard & Roe, P.C.

(57) ABSTRACT

The invention relates to a lock (1) which can be actively released and locked by control technology, particularly for use in automatic storage machines having a plurality of compartments with compartment doors (2) which are to be opened individually, and to an automatic storage machine having at least one such lock (1). The lock (1) comprises a detent pawl (14), which can lock a locking element (9), which is permanently connected to a compartment door (2), in the lock such that the compartment door (2) can be held in closed position. The lock further has a first electric drive element (17) which transitions the detent pawl (14) from the locking position to a release position upon the applying of electrical power, such that the compartment door (2) can be opened. The lock (1) further comprises a security device (32), which prevents an automatic reset of the detent pawl (14) from the release position to the locking position when the lock (1) is in an unpowered state or the automatic storage machine is in an unpowered state, and an unintentional, accidental or improper locking of a compartment door can thus be avoided. In order to properly lock a compartment door, the security device (32) of the lock (1) comprises a second electric drive element, by means of which the detent pawl (14) can be transitioned back to the locking position
(Continued)

thereof upon the applying of electrical power to said second electric drive element during closing of the compartment door (2).

23 Claims, 4 Drawing Sheets

(51) Int. Cl.

| | |
|---|---|
| ***E05B 47/06*** | (2006.01) |
| ***E05B 17/00*** | (2006.01) |
| ***A47B 81/00*** | (2006.01) |
| ***A47F 10/00*** | (2006.01) |
| ***E05B 51/00*** | (2006.01) |
| ***E05B 65/00*** | (2006.01) |
| ***E05C 3/00*** | (2006.01) |
| ***E05C 19/12*** | (2006.01) |
| ***E05C 21/00*** | (2006.01) |
| ***A47B 88/40*** | (2017.01) |
| *E05B 47/02* | (2006.01) |
| *E05B 63/14* | (2006.01) |
| *E05C 3/24* | (2006.01) |
| *E05B 47/00* | (2006.01) |

(52) U.S. Cl.
CPC ..... *E05B 17/005* (2013.01); *E05B 47/0607* (2013.01); *E05B 51/00* (2013.01); *E05B 65/0075* (2013.01); *E05C 3/002* (2013.01); *E05C 19/10* (2013.01); *E05C 19/12* (2013.01); *E05C 21/00* (2013.01); *E05B 47/0004* (2013.01); *E05B 47/023* (2013.01); *E05B 63/143* (2013.01); *E05B 2047/0069* (2013.01); *E05B 2047/0072* (2013.01); *E05C 3/24* (2013.01)

(58) Field of Classification Search
CPC .. E05B 47/00; E05B 47/0001; E05B 47/0002; E05B 47/023; Y10T 292/1082; Y10T 292/1021; Y10T 292/699; Y10T 70/5097
USPC ..... 292/95
See application file for complete search history.

(56) References Cited

U.S. PATENT DOCUMENTS

| | | | | |
|---|---|---|---|---|
| 8,328,299 | B2 * | 12/2012 | Hashemi | E05B 47/00 312/319.5 |
| 8,720,959 | B2 * | 5/2014 | Wittke | E05B 47/0047 292/201 |
| 2009/0235767 | A1 * | 9/2009 | Garneau | E05B 47/0012 74/56 |
| 2009/0236865 | A1 * | 9/2009 | Dziurdzia | E05B 17/0029 292/226 |
| 2010/0139338 | A1 * | 6/2010 | Wintersteiger | E05B 7/0696 70/78 |

* cited by examiner

LOCK HAVING A SECURITY DEVICE FOR AN AUTOMATIC STORAGE MACHINE AND AUTOMATIC STORAGE MACHINE

CROSS REFERENCE TO RELATED APPLICATIONS

This application is the National Stage of PCT/AT2014/050101 filed on Apr. 23, 2014, which claims priority under 35 U.S.C. §119 of German Application No. 10 2013 104 495.6 filed on May 2, 2013, the disclosure of which is incorporated by reference. The international application under PCT article 21(2) was not published in English.

The invention relates to a lock which can be actively released and locked by control technology and an automatic storage machine for the distribution, transfer or temporary storage of objects as described in claims 1 and 19.

An electrically unlocking or unlatching lock, which is used mainly for automatic storage machines, automated deposit box arrangements or the like, is known from EP 2 176 477 B1, which is in the name of the Applicant. A lock is described in which a locking element which is securely connected to a compartment door can penetrate through an opening in the housing of the lock into the lock. In the lock a detent pawl is arranged which with a closed compartment door can capture or block the locking element either directly or indirectly by means of a coupling member, thus preventing the opening of the door. The detent pawl on the input of an authorization signal into the lock electronics is pivoted actively by means of an electric drive member out of the locking position, in order to thus release the locking element or if necessary the coupling member and enable the opening of the door. On closing the door the detent pawl is pushed by a spring force acting thereon into the locking position so that the compartment door is locked again. Said locking process is performed without providing electric power and without needing a control signal in a passive manner. In the case of a power failure, caused either deliberately or for another reason or on the occurrence of a defect in the electronic control or if the automatic storage machine is disabled due to a fault, the compartment door cannot be opened after accidental or unauthorized shutting until the lock is supplied with power again and/or if necessary until a repair has been performed.

In automatic storage machines with larger compartments, which may be necessary or expedient depending on the purpose in each case, it is not possible to completely prevent unsupervised children from climbing into such a compartment if, contrary to the instructions, compartment doors have been left open after a collection. In addition, if the machine has been decommissioned there is a risk that someone may get locked in unintentionally. Also other instances of misuse are possible which may be caused by persons not authorized to use the machines.

The underlying objective of the present invention is an electrically controlled lock or a self-service automatic storage machine, which reduces potential risks for people or animals and which reliably prevents the unauthorized locking of open doors.

Said objective of the invention is achieved by the measures described in claim 1. By means of the security device according to the invention it is ensured that on the interruption of the power supply, which is caused intentionally or by external circumstances, for the automatic storage machines or for a higher control device in functional connection with the lock the locking of the compartment door is prevented by means of the lock according to the invention. In this way the unauthorized locking of open compartment doors is reliably prevented and the risk of children and/or animals getting locked in unintentionally or by playing can be minimized.

Advantageously, by means of the lock according to the invention the typical passive locking of a compartment door by control technology is eliminated by an electromechanical mechanism actively influenced by control technology, which comprises the said security device. Said security device reliably prevents with the omission or absence of an high power release signal, for example during a power cut or the failure of the higher control functionally connected to the lock, the uncontrolled, erroneous or unauthorized locking of a previously unlocked lock. In this way the risk of a potentially dangerous state is reduced in which locking occurs, as a result of error or by unauthorized locking, whilst a living being is located inside the storage compartment.

In particular, the design of the security device according to the invention is particularly advantageous with respect to the later decommissioning or deactivation of locker-like storage systems equipped with the lock according to the invention at the end of their lifetime. By means of the described security device of the lock the risk of a problematic situation occurring is also minimized.

It is also advantageous that the lock according to the invention comprises a mechanically simple and compact structure in which as few movable parts as possible are used.

Furthermore, for unlocking and locking the lock relatively simple drive elements are used which enable an inexpensive and structurally simple automation of the lock. In addition, it is an advantage that the electric drive elements are only activated or supplied with current for the active unlocking or locking processes respectively, so that it is possible to control the lock with relatively low, electric power requirements.

Lastly, the mechanical and electric components of the lock including the security device can be installed in a relatively compact manner into the housing. In this way a compact, one piece lock can be assembled which can be installed rapidly and easily into an automatic storage machine or storage compartment.

In particular, the lock designed according to the invention can prevent a child or an animal for example entering a compartment space through an open compartment door and the compartment door locking simply by shutting with an interrupted power supply. This thus reduces the risk that playing children or animals may get locked in or that objects are placed into open machine compartments without authorization and locked in.

A configuration of the lock according to claim 2 is also an advantage, as in this way it is possible to ensure the secure locking of closed compartment doors in the case of a power failure. Said measure prevents the automatic opening of a locked compartment door by means of the security device.

The embodiment according to claim 3 increases the manipulation security of the lock, as a pivot force acts continuously on the detect pawl on the locking mechanism of the lock, in particular with a locked compartment door. Said pivot force opposes a manipulation force also applied externally with the purpose of removing the detent pawl from its locking position.

By means of a procedure according to claim 4 during the controlled unlocking of the compartment door a prompt, automatic and operationally secure activation of the security device is ensured so that the blocking element is located straight away in its blocking position and remains in the blocking position such that only by means of a subsequent active, power-charged locking signal or power charging of the second drive element is the spring force of the second spring means overcome and it is possible to move the blocking element into the release position. In this way in the unpowered state of the lock or the higher control device the compartment doors cannot be locked so that the occurrence of a potentially dangerous state is prevented as far as possible.

The measure according to claim 5 is an advantage as in this way the activation of the security device is prevented in the locked state of the compartment door, whereby a high locking security of the lock or a storage compartment equipped with the latter is ensured. Furthermore, in this way an unwanted or unauthorized unlocking of the lock is effectively prevented with a closed compartment door, regardless of whether the lock or the higher control device is supplied with power or is in an unpowered state.

The advantageous embodiment of the security device as claimed in claim 6 ensures that in the case of an interruption in the power supply the detent pawl cannot enter the locking position with an opened compartment door, i.e. in the unlocked state of the lock. In this way the locking of the compartment door which is unintentional or caused by other reasons can be prevented by the lock.

The configuration of the means for holding the blocking element in its blocking position according to the features of claim 7 provides an efficient and operationally reliable variant for preventing a restoring of the locking element from the locking position to the release position. In this way it is ensured that a compartment door can only be locked by the higher control device for the lock in the presence of a powered locking signal or only in correct operating states.

The design of the means for holding the blocking element in the blocking position according to the features of claim 8 is particularly advantageous, as this represents a structurally simple and robust variant.

A procedure according to the features of claim 9 enables in particular the detection of the locked position of the compartment door. In this way the state of the storage compartment, i.e. whether the compartment door is open or closed, can be detected electronically. In particular, it can be detected reliably whether the locking element has entered sufficiently far into the housing of the lock to enable the locking of the compartment door by means of the detent pawl. Furthermore, by combining or linking with other status information the compartment doors which have not been closed completely or not locked correctly can be identified automatically. Consequently, by means of a higher control device suitable counter measures can be introduced or specific requirements can be set for a user.

It is also an advantage to design a movement transmitting element for activating the first detecting means, as described in claim 10. By means of this configuration the first detecting means can be arranged deep inside the lock or spaced as far apart as possible from the compartment door. In this way the manipulation of the first detecting means from the outside is made very difficult and this thus increases the operating safety of the lock.

By way of the measure according to claim 11 an operationally secure and rapid signaling of the closed position of the compartment door is provided so that the locking of the compartment door can be activated promptly. In this way the power charging of the lock can be limited to the shortest possible time period to enable the locking of the compartment door. This makes it possible to have an inexpensive control electronic system and to use as little power as possible which can be significant for example in a self-sufficient power supply, in particular with a bridging or emergency power supply.

The features of claim 12 represent a particularly simple but reliable embodiment variant of the movement transmitting element.

A configuration of the blocking element as described in the features of claim 13 is also advantageous, as in this way a means is provided for limiting the pivotability of the detent pawl in the direction of its locking position. A release generated in this way between the detent pawl and the coupling member is particularly advantageous for increasing the manipulation security of the lock, as in this way a locking position of the detent pawl can be defined in which the achieved locking effect is as secure from manipulation as possible. Furthermore, by means of such a configuration of the blocking element a different design or assembly of a separate or structurally independent limiting element in the housing of the lock can be omitted, whereby the structure can be simplified and the manufacturing costs of the lock housing can be reduced. The thus generated limiting of the pivot movement of the detect pawl in the direction of the coupling member also has the advantage that the detent pawl can also adopt the optimal locking position after a plurality of activating cycles of the lock, in which locking position the planned locking and manipulation safety is achieved. In particular, such a configuration is also particularly low wearing over the long term, as it is possible to avoid having a load-transmitting support of the detent pawl on the coupling member.

By way of the measures according to claim 14 on the one hand manipulation attempts and on the other hand malfunctions can be identified by control technology on the lock or in a storage compartment equipped with the latter. In particular, it is possible to detect reliably whether the detent pawl is located in its locking position, which in combination with the status information detected by other detecting means makes it possible to technically detect any deviations from the correct operating states of the lock.

By means of the configuration of the lock according to the features of claim 15 it is possible to determine by control technology whether the lock or the security device is functioning correctly. Furthermore, in connection with additional detecting means a conclusion can be drawn about unintended states. In addition, with the occurrence of specific parameter combinations an alarm is triggered automatically or a faulty state is signaled.

The use or installation of a balance element as described in claim 16 is particularly advantageous. In this case the balance element acts advantageously as a force balancing counter element to the detent pawl, whereby in particular the manipulation safety of the lock can be improved additionally.

By means of the embodiment described in claim 17 a structurally simple and reliable activation of the second detecting element is achieved. Furthermore, in this way the manufacturing costs of the lock and the structural size of the lock can be kept as small as possible.

The configuration or bearing of the blocking element according to the features of claim 18 has the advantage that on adjusting the blocking element the frictional forces are low. This increases the operational reliability of the security device. Furthermore, the lifetime of the security device or lock can be increased. In addition, a relatively non jamming adjustment of the locking element can be achieved between the locking position and the release position or vice versa, whereby the probability of the occurrence of a malfunction can be reduced considerably.

Furthermore, the objective of the invention is also achieved by an automatic storage machine according to claim 19. The effects and technical actions achievable by means of such an automatic storage machine can be taken from the preceding parts of the description.

By means of the measures according to claim 20 it is an advantage that the unintentional or otherwise caused closing of a compartment door of an automatic storage machine is prevented on interruption of the power supply. However, in the case of a power cut, which is intentional or caused by other reasons, the secure locking of a closed compartment door is ensured. In addition, on the occurrence of a fault or defect in the control device a potentially safety critical state can be prevented.

Lastly, by way of the measures according to claim 21 personal safety can be increased, as the closing and locking of an open compartment door is linked with the given conditions which are easily determined by control technology.

The configuration of the automatic storage machine according to claim 22 has the advantage that smaller storage compartments, which a child is very unlikely to get locked into, can be assigned structurally simpler and less expensive locks without a security device. For this a lock can be used as described in EP 2 176 477 B1 for example. This modular use of locks with different configuration levels enables solutions for automatic storage machines which are fit for purpose, as inexpensive as possible and yet are still reliable.

Lastly, the measure according to claim 23 ensures that it is largely impossible or at least extremely difficult to open a locked compartment door by force, even if said compartment door has relatively large dimensions, in particular a relatively large height.

For a better understanding of the invention the latter is explained in more detail with reference to the following Figures.

In a much simplified, schematic view.

Figure 1:
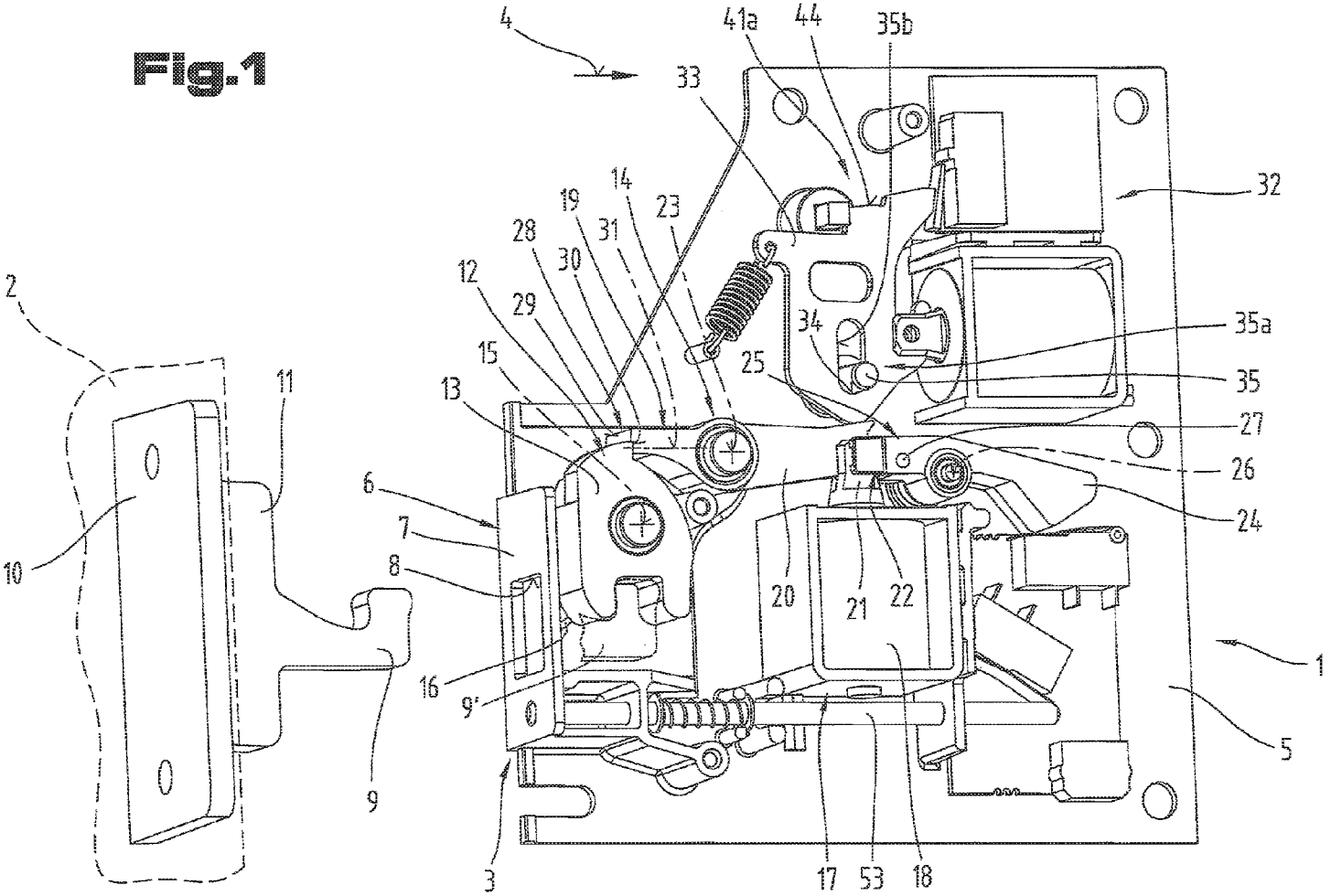
FIG. 1 is an embodiment of an embodiment of a lock designed according to the invention in its locked state in a perspective view by way of example.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a perspective view of a lock 1 designed according to the invention with a removed side or cover part. Said lock 1 is particularly suitable mainly for automatic storage machines—FIG. 4—, in particular for deposit box systems or so-called parcel depots, which are designed to be used by a general or if necessary registered group of people. In particular, by means of said lock 1 a schematically indicated compartment door 2 for a storage compartment can be unlocked and locked by control technology inside a compartment arrangement of the automatic storage machine—FIG. 4. For this the lock 1 according to the invention is connected to an electric control device, which can perform an automated or remote controlled unlocking of the lock 1, if there is right of access to the corresponding storage compartment previously locked by the compartment door 2. Likewise, the control device can be designed such that the locking of the compartment door 2 is controlled as soon as a corresponding control signal is triggered by the manual closing and shutting of the compartment door 2 and authorization is provided for locking the corresponding compartment door.

The lock 1 has a housing 3 that is as stable as possible. An extension of the housing 3 can run parallel to the depth direction of a compartment according to arrow 4 in FIG. 1. By means of the lock 1 in connection with the compartment door 2 access to the storage compartment can be controlled. The housing 3 of the lock 1 comprises at least one plate-like base part 5 and possibly a not shown, cover-like side or upper part, between which the inner chamber is defined for holding the electromechanical lock components. In this case mechanical and electric components of the lock 1 are stored or mounted either on the inside of the suitably solid and robust housing 3 or on the base part 5, which forms the housing 3 itself.

For example, the base part 5 has an angular deflection 6 which forms an end wall plate 7 of the housing 3. In said end wall plate 7 an opening 8 is formed which allows the insertion of a locking element 9 or a corresponding locking bolt into the housing 3 of the lock 1. Said locking element 9, which can be shaped for example to be hook-like, bracket-like or eyelet-like, or can be formed by a locking bolt with undercuts or with cross-sectional widenings, is preferably connected via a mounting plate 10 as rigidly as possible and in a tear-proof manner to a corresponding compartment door 2, in particular is screwed. In FIG. 1 the position of the locking element 9 is shown with a locked compartment door 2 by dashed lines and marked as a locking element 9'.

According to an advantageous embodiment the mounting plate 10 for the locking element 9' can be supported in the closed and locked state of the compartment door 2 with the interconnection of at least one spacing and screw fastening means 11 for the mounting plate 10 on the compartment door 2 in a load-transmitting manner on the housing 3 of the lock 1, in particular on its end wall plate 7. Said spacing and screw fastening means 11 is preferably made in one piece, in the manner of a block, however it can also be formed for example by one or more cylinder bodies, which ensure mutual support between the compartment door 2 or between the mounting plate 10 for the locking element 9 or 9' and the housing 3 of the lock 1. This prevents the locking element 9 or 9' in case of impact or pressure on the compartment door 2 from penetrating into the housing 3 further than permitted, whereby damage to the lock mechanism or the lock electronics can be prevented in a simple manner.

The described lock mechanism is designed to be particularly simple and at the same time to be relatively secure from manipulation. Inside the housing 3 of the lock 1 according to the embodiment of FIG. 1 a coupling member 12 is mounted, which is preferably formed by a so-called rotary latch 13, for forming and lifting a mechanical coupling between the locking bolt and the locking element 9' and a detent pawl 14. Said coupling member 12 for holding the locking element 9' or a corresponding holding or locking bolt in a form-fitting manner is blocked on adopting its locking position for the compartment door 2—as shown schematically in FIG. 1—by the pivotably mounted detent pawl 14 from movement into its opening position—not shown in FIG. 1. In the open position of the coupling member 12 the locking element 9 and the coupling member 12 are disengaged, so that the locking element 9 of the housing 3 of the lock 1 is released and the compartment door 2 can be opened.

The coupling member 12 designed preferably as a rotary latch 13 is mounted rotatably about an axle 15 which runs perpendicular to the insertion direction of the locking element 9 into the lock housing 3. The rotary movement of the rotary latch 13 about the axle 15 is thus controlled via the detent pawl 14, in particular is released or locked. In the locking position of the lock 1 shown in FIG. 1 the detent pawl 14 blocks the twisting of the rotary latch 13 in opening direction and thus the rotary latch 13 secures the locking element 9' engaging therein inside the housing 3 of the lock 1. On adopting the release position by means of the detent pawl 14 the rotary latch 13 can pivot and be pivoted in opening direction, so that it is possible to remove the locking element 9 from the housing 3, as necessary for opening the compartment door 2.

Preferably, the rotary latch 13—as already known—is pretensioned by means of a spring means 16 in opening direction so that the rotary latch 13 is pushed with an inactive position or release position of the detent pawl 14 into the opening position, whereby the compartment door 2 via the locking element 9' engaging therein ring element 9' springs open forming at least a gap width.

In any case an embodiment variant of the lock construction is possible without a rotary latch 13 or without a coupling member 12, in which alternative embodiment variant the detent pawl 14 in the locked state of the compartment door 2 is in direct engagement with the locking element 9. The preferred embodiment variant of the lock 1 comprises a coupling member 12 or a rotary latch 13.

The detent pawl 14 is movably coupled to a first drive element 17, preferably with a first electromagnet 18 in the manner of a tie bar magnet. In particular, the position of the detent pawl 14 can be controlled automatically by means of the first drive element 17 into a release position in which there is a rotary movement of the rotary latch 13 in the direction of its opening position.

The detent pawl 14 is preferably designed as a two-armed lever, the first lever arm 19 of which represents the detent pawl 14 and works together with the coupling member 12. The second lever arm 20 is thus connected movably to the preferably electrically activatable first drive element 17. In particular, the second lever arm 20 of the detent pawl 14 is coupled movably to the linearly movable armature 21 of the first drive element 17 via a joint connection 22 such that by means of the linear downwards or upwards lift of the armature 21 the detent pawl 14 is moved from its locking position—according to FIG. 1—into its release position, or can be moved from its release position into the locking position. Here the detent pawl 14 performs a pivot movement about a pivot axis 23.

Furthermore, it is possible that a balance element 24 is movably coupled to the first drive element 17 or its armature 21 via the joint connection 22. Said balance element 24 is also designed as a lever, wherein the first lever arm 25 of the balance element 24 is movably connected to the first electric drive element 17 via the joint connection 22. By means of the linear downwards and upwards lift of the armature 21 the balance element 24 performs a pivot movement about its pivot axis 26. The joint connection 22 is configured such that the detent pawl 14 and the balance element 24 are movably coupled to one another by means of the joint connection 22. To improve the manipulation security of the lock 1 advantageously the balance element 24 and the detent pawl 14 and the armature 21 of the first electric drive element 17 are balanced out at least approximately in terms of mass and/or force. The three movably coupled elements detent pawl 14, balance element 24 and armature 21 are balanced out such that on the introduction of translational or rotational pulses into the lock housing 3, such as during violent impact on the automatic storage machine or a compartment door 2, it is possible that there are no resulting movements of said three coupled elements and thus also the detent pawl 14 and thus the compartment door 2 remains reliably locked.

Preferably, a first spring means 27 is designed, the spring force of pushes the detent pawl 14 continually and continuously into its locked position or locking position. Said spring means 27 can be assigned directly to the detent pawl 14, however it can also be assigned to the first drive element 17 or the armature 21. For example, the spring means 27 for the automatic transfer of the detent pawl 14 into the locked position is assigned to the balance element 24 and in the unpowered or currentless state of the first electric drive element 17 an extended position of the armature 21 relative to the drive element 17 is possible, whereby the detent pawl 14 is pushed into its locking position shown in FIG. 1.

The end face 28 of the detent pawl 14 facing the coupling member 12, in particular the rotary latch 13, bears bluntly on the coupling member 12, when the lock 1 is in the locked state shown in FIG. 1. In particular, on the end face 28 of the detent pawl 14 a support surface 29 is formed which bears bluntly on a thrust bearing face 30 of the coupling member 12, when the detent pawl 14 is in the locked position. The thrust bearing face 30 on the coupling member 12 is aligned on adopting the locking position of the detent pawl 14 at right angles or at least approximately at right angles to the longitudinal axis 31 of the detent pawl 14.

In addition, in FIG. 1 a security device 32 is shown which is assigned to the lock 1 or which security device 32 prevents the passive locking by control technology of the compartment door 2. Rather, a control technology active locking of the lock 1 or the compartment door 2 is contingent on the security device 32

As shown in FIG. 1 for the lock 1 in its locked state, the second lever arm 20 of the detent pawl 14 in the region of the joint connection 22 is in contact with a blocking element 33, which blocking element 33 is designed as a component of the security device 32. Said blocking element 33 preferably comprises a limiting means 34, which limiting means 34 is in force-transmitting interaction with a structurally independent limiting stop 35, when the detent pawl 14 is located in the locking position. In the example embodiment shown in FIG. 1 the limiting stop 35 is connected rigidly or immobily to the base part 5. The limiting means 34 in combination with the limiting stop 35 represents the end point of the pivot path of the detent pawl 14 in the direction of its locking position, so that by means of the limiting means 34 and the limiting stop 35 the locking position of the detent pawl 14 is defined. This means that the detent pawl 14 on adopting its locking position bears in a load-transferring manner or supporting manner on the blocking element 33.

The blocking element 33 can be mounted adjustably translationally and rotationally by means of a linear and pivot bearing **35*a* relative to the housing 3 or base part 5. A guide of the linear or pivot movement of the blocking element 33 is formed in the embodiment variant shown in FIG. 1 by a recess 35***b* in a blocking element 33, which recess 35*b* interacts with the limiting stop 35 during an adjusting movement of the blocking element 33.

Figure 2:
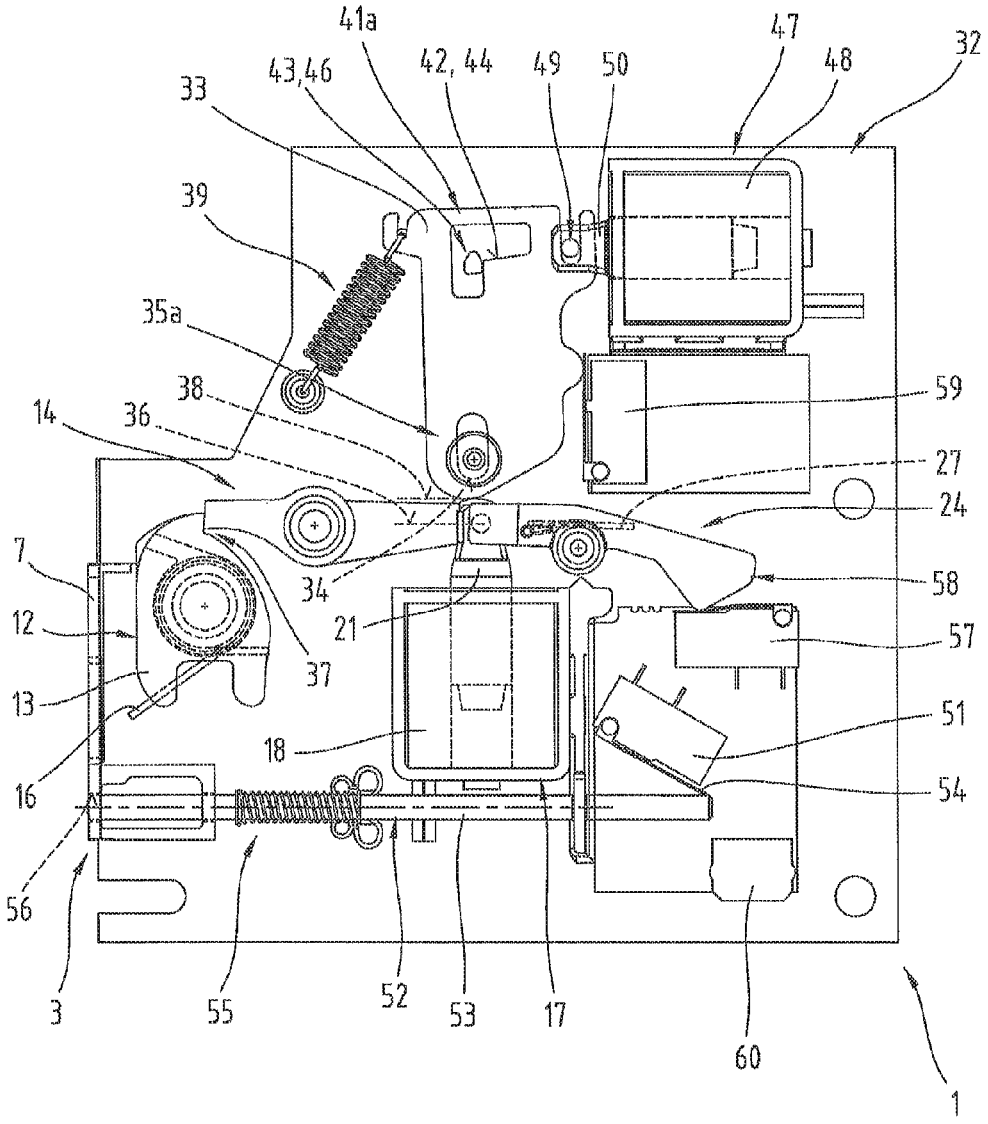
FIG. 2 is a further embodiment of the lock according to the invention in its locked state, in side view.

FIG. 2 represents an embodiment of a lock 1 according to the invention that is structurally slightly different from FIG. 1. FIG. 2 shows the lock 1 in the locked state, that is with a detent pawl 14 located in a locking position 36. In FIG. 2 to provide a better overview the elements of the storage compartment interacting with the lock 1, in particular the compartment door and the locking insertable into the lock 1, are no longer shown.

As shown in FIG. 2, because of the restriction of the pivot movement of the detent pawl 14 via the limiting means 34 and the limiting stop 35 a physical and structural release 37 can be formed so that the detent pawl 14 in its locking position 36 does not bear on the rotary latch 13 or the coupling member 12. This prevents the detent pawl 14 being moved in an unpredicted or undesirable manner into its unlocking position or release position by introducing a pulse or force onto the coupling member 12, which pulse can be introduced via the housing 3 of the lock 1 and/or the locking element.

Figure 3:
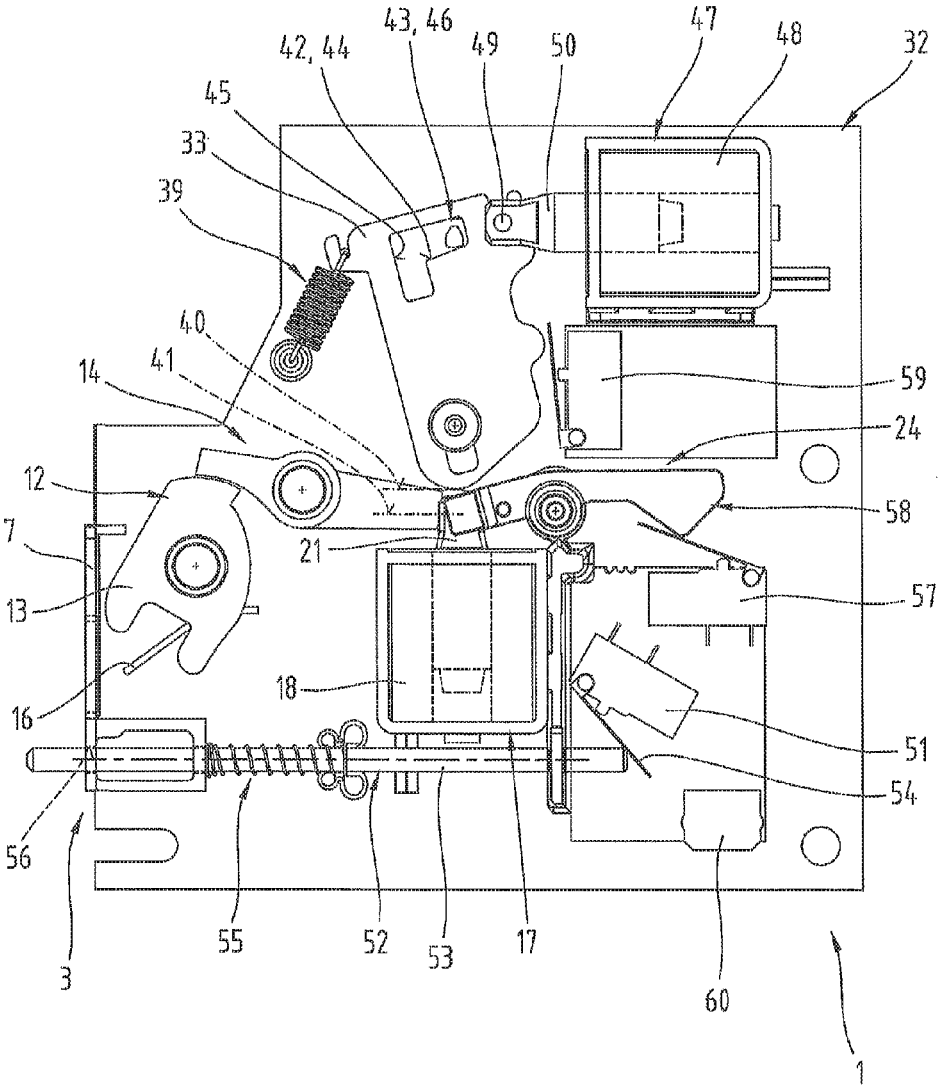
FIG. 3 is the lock according to FIG. 2 in an opened state in side view.

Alternatively and/or in addition to restricting the pivotability of the detent pawl 14 in the direction of the locking position 36 by means of the blocking element 33, a limiting stop, which is not shown in FIGS. 1 to 3 and is arranged separately, in particular a structurally independent limiting stop can be designed for limiting the pivotability of the detent pawl 14. Such a separately arranged limiting stop can thus be assigned directly to the detent pawl 14, but can also be assigned to the balance element 24.

In the locking position 36 of the detent pawl 14 shown in FIG. 2 the blocking element 33 is in its release position 38. A second spring means 39 is preferably assigned to the blocking element 33, the spring force of which is used to continuously push the blocking element 33 into its blocking position 40 shown in FIG. 3. In order to prevent the automatic adoption of the blocking position 40 by the blocking element 33 in the locked state of the lock 1 shown in FIG. 2, that is with a detent pawl 14 located in a locking position 36, the first spring means 27 and the second spring means 39 are configured or adjusted to one another so that the force which is exerted effectively by the first spring means 27 onto the detent pawl 14 is greater than the force exerted effectively by the second spring means 39 onto the blocking element 33. In this way with a detent pawl 14 located in the locking position 36 in the unpowered state of the first electric drive element 17 the blocking element 33 is pushed continuously into the release position 38, and thus the unwanted or unauthorized unlocking of the lock 1 is effectively prevented with a closed compartment door, regardless of whether the lock 1 is supplied with current or is unpowered.

The detent pawl 14 is mainly pivoted actively out of the locking position 36 on the input of an unlocking signal into the lock 1 by means of the first electric drive member 17 or is moved into its release position 41 shown in FIG. 3, in order to thus release the coupling member 12 or if necessary the release the locking element directly and to enable the opening of the compartment door. By means of this process the action of force of the first spring means 27 is overcome so that the blocking element 33 of the security device 32 is moved by the second spring means 39 into its blocking position 40 shown in FIG. 3.

The blocking element 33 shown in FIGS. 1 to 3 also comprises a means 41*a* for holding the blocking element 33 in the blocking position 40, which means 41*a* is designed such that in the absence of a power supply for the lock 1 or the higher control device, the automatic transfer of the detent pawl 14 from the release position 41 shown in FIG. 3 to the locking position 36 shown in FIG. 2 is prevented. In particular, the means 41*a* for holding the blocking element 33 opposes the force exerted by the first spring means 27 on the detent pawl 14.

The means 41*a* for holding the blocking element 33 in the blocking position 40 can be designed in two parts and formed by a holding means 42 formed on the blocking element 33 and a holding element 43 assigned to the blocking element 33. In this case the holding means 42 and the holding element 43 with a blocking element 33 located in the blocking position 40 bear on one another in a load or force-transmitting manner and prevent a spring-force determined transfer of the blocking element 33 into the release position 38. In this way it is possible to prevent a control technology inactive or mechanically automatic locking of the compartment door in the unpowered state of the lock 1 or the higher control device. Also during the manual closing or shutting of the compartment door and the associated transfer of the coupling member 12 forced by the locking element from the opening position shown in FIG. 3 into the closed position shown in FIG. 2, in the unpowered state of the lock 1 the detent pawl 14 cannot be moved into its locking position 36, as this is prevented by the blocking element 33 held in its blocking position 40.

In the embodiment shown in FIG. 2 and FIG. 3 the holding means 42 is designed as a bearing surface 44 formed inside the blocking element 33, which bearing surface 44 is defined by a recess 45 in the blocking element 33. Said bearing surface 44 in the blocking element 33 is supported with a blocking element 33 located in the blocking position 40 on a holding pin 46 or holding bolt connected securely or rigidly to the housing 3 of the lock 1 in a load or force transmitting manner.

Alternatively, the holding pin 46 or holding bolt can also be designed as an axle, which supports a bearing sleeve or a small roller bearing not shown in the Figures, whereby the bearing surface 44 then rolls off the bearing. In this way the frictional force between the holding pin 46 and the bearing surface 44 can be reduced significantly or largely removed, whereby the required force of the electromagnet 48 for moving the blocking element 33 into the release position 38 is reduced and overall the reliability and long-term stability is improved. Likewise, in this way the wear of the holding pin 46 and the bearing surface 44 is reduced.

It should be noted at this point that the embodiment of the lock 1 and security device 32 shown in FIG. 2 and FIG. 3 should only be considered as an example for a plurality of embodiment options or variants for a lock 1 according to the invention. Thus for example the embodiment shown in FIG. 1 shows a structurally and constructionally slightly modified form of the blocking element 33. In this case the bearing surface 44 is not formed by a recess in the blocking element 33, but is defined by a section of the upper edge of the blocking element 33. It is essential that the lock 1 comprises a blocking element 33, to which blocking element 33 a means 41*a* is assigned directly and/or indirectly for holding the blocking element 33 in the blocking position 40. Said means 41*a* overcomes the force exerted by the spring means 27 on the detent pawl 14, which acts in the direction of its locking position 36. In this way in the opened state of the storage compartment or the compartment door with an interruption of the power supply or other fault in the correct operation of the automatic storage machine a backwards pivoting of the detent pawl 14 into its locking position 36 is prevented, as the blocking element 33 cannot be moved by the means 41*a* for holding the blocking element 33 in its blocking position 40 into the release position 38.

For the purpose of locking the storage compartment or the lock 1 the blocking element 33 is rather movably coupled to a second electric drive element 47, preferably to a second electromagnet 48 in the manner of a tie bar magnet. In the example embodiment shown in FIG. 2 and FIG. 3 the blocking element 33 is movably coupled via a joint connection 49 to an armature 50 of the second electric drive element 47. If authorization is provided for locking the storage compartment and a signal that the locking element has entered far enough into the lock housing 3, the second electric drive element 47 is activated by the superordinate control device. In the example embodiment shown in FIG. 2 and FIG. 3 by charging the second electric drive element 47 with power the holding pin 46 is moved out of engagement with the bearing surface 44 so that after a sufficient rotation of the rotary latch 13 during the closing of the compartment door the detent pawl 14 is moved via the pretensioning of the first spring means 27 into the locking position 36, and the blocking element 33 is lifted with the movement of the detent pawl 14 into its release position 38 shown in FIG. 2. This results in an adjustment of the blocking element 33 via a translational and rotational movement into the release position 38. Alternatively, the blocking element 33 can also be moved from its blocking position 40 into the release position 38 directly by the second electric drive element 47.

Lastly, by means of the measures explained above, the lock 1 on shutting the compartment door can only lock the compartment door if in this time period the second electric drive element 47 is powered and the first electric drive element 17 is not powered, i.e. if the superordinate control device sends a high power, active locking signal to the lock 1.

Preferably, a signal triggered by manually closing the compartment door 2, which signal is used for activating the second electric drive element 47, is supplied by a first detecting means 51. Said first detecting means 51 is used for determining whether the locking element 9'—FIG. 1—has been introduced into the housing 3 of the lock 1 so that it can be stopped or secured by means of the coupling member 12. The first detecting means 51 is preferably influenced by a movement transmitting element 52, which movement transmitting element 52 is activated by the manual closing of the compartment door. In particular, the movement transmitting element 52 is designed as a linearly adjustable, spring elastic pretensioned ram element 53. In the locked state of the lock 1 shown in FIG. 2 said ram element 53 extends between the end wall plate 7 and an activating element 54 of the first detecting means 51, in particular into the adjustment path of a switching flag of the first detecting means 51. The linearly adjustable ram element 53 is thus aligned at an acute angle to the activating element 54, wherein the ram element 53 and the detecting means 51 are positioned relative to one another such that during an unpredictably extended, manipulatory insertion of the ram element 53 into the housing 3 of the lock 1 the end of the ram element 53 is moved past the detecting means 51 and the detecting means 51 does not function as an end stop for the ram element 53.

With the existing power supply for the lock 1 or for the higher control device and with authorisation for closing the storage compartment, if the first detecting means 51 is triggered the blocking element 33 can be transferred indirectly or directly by the charging with power the second electric drive element 47 from the blocking position 40 into the release position 38, which enables the correct locking of the compartment door 2 by the lock 1.

During the unlocking of the compartment door triggered by means of control technology a spring means 55 assigned to the ram element 53 can cause a linear displacement of the ram element 53 in the direction of the end wall plate 7 of the housing 3 of the lock 1. In this case the ram element 53 exits through an opening 56 in the end wall plate 7 partly out of the housing, as shown FIG. 3. Furthermore, the spring element 55 can also be effective in a supporting manner in addition to the spring means 16 of the rotary latch 13 for opening or automatically springing open the compartment door.

During the manual closing or shutting of the compartment door 2 the ram element 53 is moved either by the compartment door itself or—as shown in FIG. 1—by the spacing and screw securing means 11 connected to the locking element 9 back into the position shown in FIG. 2. In this way the activating element 54 of the first detecting means 51 is influenced or activated, which can be used as a control technical signal for activating or powering the second electric drive element 47.

In addition, a second detecting means 57 can be designed for detecting the respective position of the detent pawl 14, in particular for detecting at least one end position of the armature 21 of the first electromagnet 18. Said second detecting means 57 can be activated by the second lever arm 58 of the balance element 24, as shown in FIG. 2. The second detecting means 57 can however also be positioned on the side of the first electromagnet 18 opposite the armature 21, in particular on the side of the electric coil of the electromagnet 18 opposite the armature 21. In this case a continuation of the armature 21 passes through the coil arrangement and thereby activates the second detecting means 57. The second detecting means 57 can in particular be provided for detecting the active position of the first drive element 17, in particular for detecting, whether the armature 21 has been attracted by the first electromagnet 18 or not. In the arrangement shown in FIG. 2 on activating the detecting means 57 by the balance element 24 the passive position of the armature 21 or the locking position of the lock 1 is determined.

Furthermore, the position of the blocking element 33 or the position of the second electric drive element 47, in particular the position of the armature 50 of the second electromagnet 48 can be detected by a third detecting means 59. In this case the third detecting means 59 can be actuvated by the blocking element 33, as shown in FIG. 2 for the release position 38 of the blocking element 33. Alternatively, the third detecting means 59 can be positioned on the side of the second electromagnet 48 opposite the armature 50, in particular on the side of the electric coil of the electromagnet 48 opposite the armature 50.

The detecting means 51, 57, 59 are preferably formed by electric switching elements, in particular by closing and/or opening contacts. The respective detecting signals or switching states of the detecting means 51, 57, 59 can be transmitted via an electric plug connection 60 to a not shown control or evaluation device.

Figure 4:
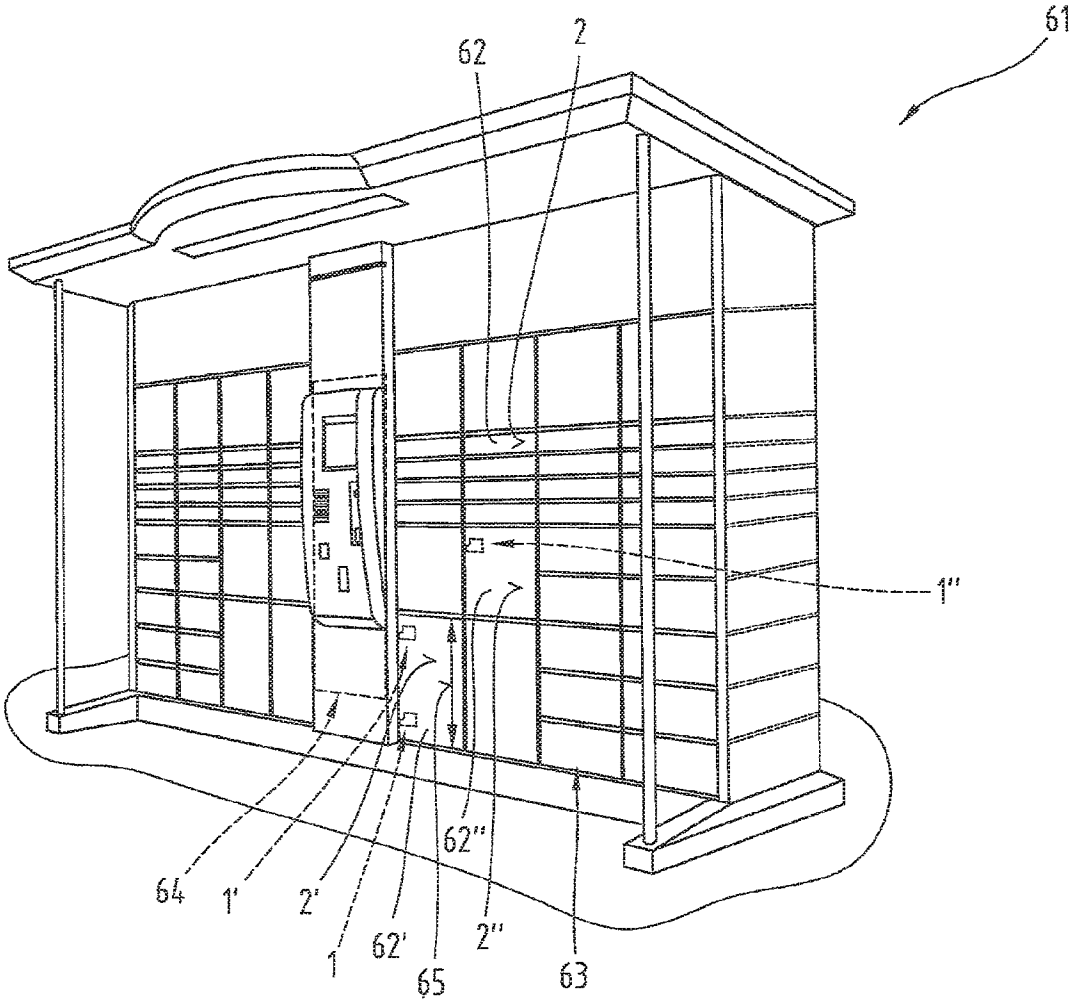
FIG. 4 is an example embodiment of an automatic storage machine, which is equipped with at least one lock according to the invention.

FIG. 4 illustrates an automatic storage machine 61 for the distribution, transfer or temporary storage of objects, in particular goods or post, to a plurality of persons. The objects to be distributed and transferred to authorised persons can be placed by at least one authorised delivery agent in a storage compartment 62, 62', 62" of a compartment arrangement 63 of the automatic storage machine 61 consisting of a plurality of storage compartments 62, 62', 62"

and are stored temporarily in the corresponding storage compartment 62, 62', 62" up to the point when the object is collected by an authorised person. Each storage compartment 62, 62', 62" is assigned at least one compartment door 2, 2', 2" which compartment doors 2, 2', 2" can be unlocked in a controlled manner at least by means of a lock 1, 1', 1" controllable by the control device 64, so that deposited objects can be released as a function of rights of use or authorisation to the respective object or to the respective storage compartment 62, 62', 62" to authorised persons for removal. The automatic storage machine 61 comprises here at least one lock 1, 1', 1" designed according to the invention.

It is advantageous, if the at least one compartment door 2, 2', 2" can be locked by means of at least one lock 1, 1', 1" according to the invention only if there is a power supply to the control device 64 and the control device 64 functions correctly and according to plan.

Furthermore, the control device 64 can be designed such that the at least one compartment door 2, 2', 2" can only be locked by means of the at least one lock 1, l', 1" if a person has the right or authorisation to use it or only when an authorised person makes a request to the control device 64.

In principle, an automatic storage machine 61 can comprise storage compartments 62, 62', 62" of variable size and dimensions with respect to their height, width and depth. Likewise, the arrangement of such structurally differently designed storage compartments 62, 62', 62" inside the compartment arrangement 63 of the automatic storage machines 61 can be selected freely.

Often for ergonomic reasons larger storage compartments 62', 62" are arranged in the lower section of an automatic storage machine 61. In particular, with such storage compartments 61', 62", because of their position in the compartment arrangement (63) or because of their compartment size, it is not possible to exclude the fact that a child may become locked inside. Therefore, the installation of locks 1, 1', 1" according to the invention in such storage compartments 61', 61" is particularly advantageous. For storage compartments 62, which because of their position or compartment size would prevent a child getting locked inside, a lock can also be used in principle which does not comprise a security device according to the invention.

Lastly, in storage compartments 62' with a particularly large height 65, the installation of more than one lock 1, 1' may be expedient, in order to secure the corresponding compartment door 2' sufficiently over the whole compartment height 65 from being opened by force. For this purpose the locks 1, 1' can be arranged spaced apart from one another in the direction of the compartment height 65 of the storage compartment 62'. A measure of this kind can be used in practice for example from a compartment height 65 that is equal to or more than 50 cm.

The example embodiments show possible embodiment variants of the lock 1 or the automatic storage machine 61, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the lock 1 and the automatic storage machine 61 the latter and its components have not been represented true to scale in part and/or have been enlarged and/or reduced in size.

The underlying problem addressed by the independent solutions according to the invention can be taken from the description.

Mainly the individual embodiments shown in FIGS. 1, 2, 3, 4 can form the subject matter of independent solutions according to the invention. The objectives and solutions according to the invention relating thereto can be taken from the detailed descriptions of these figures.

Furthermore, individual features or combinations of features of the shown and described different example embodiments can form in themselves independent solutions according to the invention.

List of Reference Numerals

| | |
|---|---|
| 1, 1', 1" | lock |
| 2, 2', 2" | compartment door |
| 3 | housing |
| 4 | depth direction |
| 5 | base part |
| 6 | angular deflection |
| 7 | end wall plate |
| 8 | opening |
| 9, 9' | locking element |
| 10 | mounting plate |
| 11 | spacing and screw fastening means |
| 12 | coupling member |
| 13 | rotary latch |
| 14 | detent pawl |
| 15 | axle |
| 16 | spring means |
| 17 | drive element |
| 18 | electromagnet |
| 19 | lever arm |
| 20 | lever arm |
| 21 | armature |
| 22 | joint connection |
| 23 | pivot axis |
| 24 | balance element |
| 25 | lever arm |
| 26 | pivot axis |
| 27 | spring means |
| 28 | end face |
| 29 | support surface |
| 30 | thrust bearing face |
| 31 | longitudinal axis |
| 32 | security device |
| 33 | locking element |
| 34 | limiting means |
| 35 | limiting stop |
| 35a | linear and pivot bearing |
| 35b | recess |
| 36 | locking position |
| 37 | release |
| 38 | release position |
| 39 | spring means |
| 40 | blocking position |
| 41 | release position |
| 41a | means |
| 42 | holding means |
| 43 | holding element |
| 44 | bearing surface |
| 45 | recess |
| 46 | holding pin |
| 47 | drive element |
| 48 | electromagnet |
| 49 | joint connection |
| 50 | armature |
| 51 | detecting means |
| 52 | movement tranferring element |
| 53 | ram element |
| 54 | activating element |
| 55 | spring means |
| 56 | opening |

-continued

| List of Reference Numerals | |
|---|---|
| 57 | detecting means |
| 58 | lever arm |
| 59 | detecting means |
| 60 | plug connection |
| 61 | automatic storage machine |
| 62, 62', 62" | storage compartment |
| 63 | compartment arrangement |
| 64 | control device |
| 65 | compartment height |

The invention claimed is:

1. A lock (1) which can be actively released and locked by control technology, a plurality of the locks for use in automatic storage machines having a plurality of compartments with individually opening compartment doors (2), with each of the compartment doors having a respective locking element (9) insertable into a respective one of the locks (1), each the locking element defining a locking hook or locking bolt, in which a respective one of the locking elements (9) can be locked in a respective one of the locks (1) and thereby keeps a respective compartment door (2) securely connected to the locking element (9) in a closed position; the lock comprising:

a detent pawl (14) which can be adjusted rotationally to a limited degree, the pawl adopting a locking position (36) via at least one movably mounted coupling member (12) cooperating with the locking element (9), wherein forces from the locking element (9) resulting from an opening force on a held closed compartment door (2) are transmitted via the coupling member (12) to the detent pawl (14) and from a pivot axis (23) of the detent pawl (14) to a housing (3) of the lock (1), a first electric drive element (17) coupled movably to the detent pawl (14), the first electric drive element defining a first electromagnet (18), for the controlled adjustment of the detent pawl (14) from the locking position (36) into a release position (41), a security device (32), the security device (32) comprises a blocking element (33), the blocking element (33) adopts a blocking position when the detent pawl (14) is located in the release position (41) (40), wherein a means (41*a*) for holding the blocking element (33) in the blocking position (40) is designed such that in the unpowered state of the lock (1) or in the unpowered state of a higher control device (64) functionally connected to the lock (1), the automatic restoring of the detent pawl (14) from the release position (41) to the locking position (36) is prevented, wherein the security device (32) comprises a second electric drive element (47), the second electric drive defining a second electromagnet (48), such that by means of which the second electric drive element (47), on charging with electric power, the blocking element (33) can be moved from its blocking position (40) into a release position (38) so that with an existing power supply for the lock (1) or the higher control device (64) functionally connected to the lock (1) during the closing of the compartment door (2) the detent pawl (14) can be moved into its locking position (36).

2. The lock as claimed in claim 1, wherein the blocking element (33) is pushed into the release position (38) with the detent pawl (14) located in a locking position (36) and in the unpowered state of the first electric drive element (17).

3. The lock as claimed in claim 1, wherein a first spring means (27) is formed, the spring force of which pushes the detent pawl (14) continuously into its locking position (36).

4. The lock as claimed in claim 3, wherein the forces acting effectively via the first spring means (27) on the detent pawl (14) are greater than the forces acting effectively via the second spring means (39) on the blocking element (33).

5. The lock as claimed in claim 1, wherein the security device (32) comprises a second spring means (39), the spring force of which pushes the blocking element (33) continuously into its blocking position (40).

6. The lock as claimed in claim 1, wherein the means (41*a*) for holding the blocking element (33) in the blocking position (40) opposes the force exerted by the first spring means (27) on the detent pawl (14) and prevents the movement of the detent pawl (14) into the locking position (36).

7. The lock as claimed in claim 1, wherein the means (41*a*) for holding the blocking element (33) in the blocking position (40) is formed by a holding means (42) formed on the blocking element (33) and a holding element (43) assigned to the blocking element (33), which holding means (42) and holding element (43) with a blocking element (33) located in blocking position (40) bear on one another in a load and force-transmitting manner such that it is not possible to move the detent pawl (14) into the locking position (36).

8. The lock as claimed in claim 7, wherein the holding means (42) is designed as a bearing surface (44) formed on the blocking element (33), which bearing surface with a blocking element (33) located in blocking position (40) is supported on a holding pin (46) connected securely to the housing (3).

9. The lock as claimed in claim 1, wherein a first detecting means (51) is formed which is provided for detecting a locking element (9) inserted into the housing (3).

10. The lock as claimed in claim 9, wherein the detecting means (51) is influenced by a movement transmitting element (52) activated during the closing of the compartment door (2).

11. The lock as claimed in claim 10, wherein the movement transmitting element (52) is designed as a ram element (53), which ram element (53) during the closing of the compartment door (2) activates the first detecting means (51).

12. The lock as claimed in claim 9, wherein the blocking element (33) with the existing power supply for the lock (1) or for a higher control device (64) functionally connected to the lock (1) can be moved on triggering the first detecting means (51) by the second electric drive element (47) from its blocking position (40) into the release position (38).

13. The lock as claimed in claim 1, wherein the blocking element (33) comprises a limiting means (34), to which limiting means (34) a limiting stop (35) securely connected to the housing (3) is assigned, which limiting stop (35) in cooperation with the limiting means (34) positions the blocking element (33) in its release position (38) such that the pivotability of the detent pawl (14) is delimited in the direction of its locking position (36) by the blocking element (33).

14. The lock as claimed in claim 1, wherein a second detecting means (57) is provided for detecting the position of the detent pawl (14) or the position of the armature (21) of the first electric drive element (17).

15. The lock as claimed in claim 1, wherein the detent pawl (14) is coupled movably at its end section facing away from the coupling member (12) to a balance element (24) pivotable about a pivot axis (26).

16. The lock as claimed in claim 1, wherein a third detecting means (59) is provided for detecting the position of the blocking element (33) or the position of the armature (50) of the second electric drive element (47).

17. The lock as claimed in claim 14, wherein the position of the detent pawl (14) or the position of the armature (21) of the first electric drive element (17) can be determined via the balance element (24) by the second detecting means (57).

18. The lock as claimed in claim 1, wherein the blocking element (33) is mounted to be adjustable by translation and rotation by means of linear and pivot bearing (35*a*) relative to the housing (3).

19. An automatic storage machine (61) for the distribution, transfer or temporary storage of objects, in particular goods or post, to a plurality of persons, wherein the objects to be distributed and transferred to authorized persons can be placed by at least one authorized delivery agent in a storage compartment (62, 62', 62") of a compartment arrangement (63) of the automatic storage machine (61) comprising a plurality of storage compartments (62, 62', 62") and are stored temporarily in the corresponding storage compartment (62, 62', 62") up to the point when the object is collected by an authorized person, wherein each storage compartment (62, 62', 62") is assigned at least one compartment door (2, 2', 2"), which compartment doors (2, 2', 2") can be unlocked in a controlled manner at least by means of a lock (1, 1', 1") controllable by a control device (64), so that deposited objects can be released as a function of rights of use or access to the respective object or to the respective storage compartment (62, 62', 62") to authorized persons for removal, wherein the automatic storage machine (61) comprises at least one lock (1, 1', 1") according to claim 1.

20. The automatic storage machine as claimed in claim 19, wherein the at least one compartment door (2) can be locked by means of the at least one lock (1) only in the presence of a power supply for the control device (64) and with the correct, planned functioning of the control device (64).

21. The automatic storage machine as claimed in claim 19, wherein the control device (64) is designed such that the at least one compartment door (2) can be locked by means of the at least one lock (1) only if a person is authorized to use the device or only when person makes a request to the control device (64).

22. The automatic storage machine as claimed in claim 19, wherein the lock (1, 1', 1") is assigned exclusively to storage compartments (62', 62"), for which because of their position inside the compartment arrangement (63) or because of their compartment size the chance of a child being locked in cannot be excluded in principle.

23. The automatic storage machine as claimed in claim 19, wherein the compartment door (2') of a storage compartment (62') with a compartment height (65) of more than 50 cm is assigned a first lock (1) and at least one further lock (1'), which locks (1, 1') are spaced apart from one another in the direction of the compartment height (65).

* * * * *